US005317358A

United States Patent [19]

Kawada

[11] Patent Number: 5,317,358

[45] Date of Patent: May 31, 1994

[54] PHOTOGRAPHIC FILM TRANSPORTING MEMBER, PHOTOGRAPHIC FILM TRANSPORTING APPARATUS AND PHOTOGRAPHIC PROCESSING SYSTEM

[75] Inventor: Ken Kawada, Kanagawa, Japan

[73] Assignee: Fuji Photo Film Co., Ltd., Kanagawa, Japan

[21] Appl. No.: 970,146

[22] Filed: Nov. 2, 1992

[30] Foreign Application Priority Data

Nov. 6, 1991 [JP] Japan ..... 3-290127

[51] Int. Cl.[5] ..... G03D 3/08

[52] U.S. Cl. ..... 354/319; 354/322; 226/196; 226/199

[58] Field of Search ..... 354/319-321; 355/27-29, 23, 24; 271/272; 226/196, 199

[56] References Cited

U.S. PATENT DOCUMENTS

| | | | |
|---|---|---|---|
| 3,850,358 | 11/1974 | Nettles | 226/199 X |
| 4,846,387 | 7/1989 | Mano | 226/199 X |
| 5,099,274 | 3/1992 | Mirlieb et al. | 355/27 |
| 5,213,246 | 5/1993 | Crowley | 226/196 X |

*Primary Examiner*—D. Rutledge

*Attorney, Agent, or Firm*—Sughrue, Mion, Zinn, Macpeak & Seas

[57] ABSTRACT

A photographic film transporting apparatus for transporting a photographic film from a developing apparatus to a printer includes: a transport passage device formed of an elongated flexible member and having a pair of mutually opposed grooves for guiding transversely opposite ends of the photographic film and extending in a longitudinal direction of the transport passage device; and two coupling portions for respectively coupling opposite ends of the transport passage device to the developing apparatus and the printer. The photographic film can be fed out by providing at least one driving device in the transport passage device. The photographic film transporting apparatus is further provided with a driving source for imparting a driving force to the driving device and a flexible transmitting device for transmitting the driving force of the driving source to the driving device. A portion of the flexible member in which the grooves for guiding the transversely opposite ends of the photographic film are formed is made of a harder material than a remaining portion of the flexible member.

20 Claims, 9 Drawing Sheets

PHOTOGRAPHIC FILM TRANSPORTING MEMBER, PHOTOGRAPHIC FILM TRANSPORTING APPARATUS AND PHOTOGRAPHIC PROCESSING SYSTEM

BACKGROUND OF THE INVENTION

1. Field of the Invention

The present invention relates to a photographic film transporting member for transporting a photographic film from one processing apparatus to another, and to a photographic film transporting apparatus and a photographic processing system using the photographic film transporting member.

2. Description of the Related Art

When development of photographic films such as negative films is effected, the following procedure is generally taken: A plurality of negative films are connected together and are formed into a roll of negative films, a leader is attached to a leading end of the roll which is paid out, and the leader is allowed to engage a pair of sprockets so as to transport the plurality of negative films. The negative films in the form of the roll, for which development processing has been completed by a developing apparatus, are manually transported by an operator to a printer which is separate from the developing apparatus, and the negative films are placed at a predetermined position on the printer so as to effect printing.

A photographic processing system capable of effecting the entire process from the development of the negative films until printing without requiring the handling by the operator, has been proposed in which a negative developing apparatus and a printer are arranged as one unit without using the aforementioned leader. This system is arranged such that the negative developing apparatus and the printer are fixed as one unit, and an outlet of the negative developing apparatus and an inlet of the printer are connected together by means of a rigid transport passage means. In this system, the films can be transported continuously from the negative developing apparatus to the printer.

However, if the apparatus for effecting development processing and the apparatus for effecting print processing are made into one unit, there are drawbacks in that since the entire machine becomes large, the system cannot be accommodated in a predetermined space, and a working space for maintenance becomes limited, resulting in poor operating efficiency.

SUMMARY OF THE INVENTION

Accordingly, it is a first object of the present invention to provide a photographic film transporting apparatus which, when effecting different film processing operations using two types of photographic film processing apparatuses, is capable of automating a transporting process between the two apparatuses and of increasing the degree of freedom in the layout of the processing apparatuses, thereby making it possible to improve the operating efficiency in the maintenance of the apparatuses.

A second object of the present invention is to provide a photographic processing system using the aforementioned photographic film transporting apparatus.

A third object of the present invention is to provide a photographic film transporting member suitable for transporting photographic films such as negative films.

To attain the first object of the invention, in accordance with one aspect of the present invention, there is provided a photographic film transporting apparatus comprising: transport passage means formed of an elongated flexible member and having a pair of mutually opposed grooves for guiding transversely opposite ends of a photographic film and extending in a longitudinal direction of the transport passage means; and two coupling portions for respectively coupling opposite ends of the transport passage means to two photographic film processing apparatuses.

Since the transport passage means is formed of an elongated flexible member, the transport passage means can be bent or curved three-dimensionally. Hence, it is possible to increase the degree of freedom in the relative layout of one processing apparatus, such as a developing apparatus, and another apparatus, such as a printer, so that the layout in a limited space becomes possible. Furthermore, it is possible to secure a space and a passageway for operations for maintenance and the like. As the flexible material, it is possible to use various kinds of synthetic resin or a thin stainless steel sheet.

A portion of the flexible member in which the grooves for guiding the transversely opposite ends of the photographic film are formed is preferably made of a harder material than a remaining portion of the flexible member. As a result, safety in transport can be secured, the friction of the photographic film is reduced, and even if the transport passage means is bent or curved three-dimensionally, the photographic film located inside can be sent smoothly.

The photographic film transporting apparatus may preferably further comprise: at least one driving means for transporting the photographic film; a driving source for imparting a driving force to the driving means; and flexible transmitting means for transmitting the driving force of the driving source to the driving means.

If a driving force is imparted to the driving means from a driving source provided on one or the other processing apparatus, the position of the driving means changes depending on the bent condition of the transport passage means. Therefore, it is impossible to provide a rigid driving and transmitting mechanism such as a shaft. Hence, there is provided a transmitting means which undergoes, for instance, axial rotation by being driven by the driving force of a driving source. Consequently, even if the transport passage means is in a bent state, driving such as axial rotation is effected, so that the driving means can be driven via a coupling mechanism such as gears by virtue of the driving such as the axial rotation.

The driving means may be constituted by rollers, for instance. As the flexible transmitting means, it is preferable to use at least one wire which is capable of undergoing axial rotation since the wire is capable of transmitting the driving force to the rollers despite the bent condition of the transport passage means.

If the wire is used, it is preferable to provide at least one groove for accommodating the wire and extending in the longitudinal direction in the transport passage means. As the driving source, it is possible to use a driving source attached to one of the photographic processing apparatuses and mounted for transporting the photographic film in the photographic processing apparatus.

As the photographic processing apparatuses, it is possible to cite, for instance, a developing apparatus, a printer, and an apparatus for cutting the photographic film into pieces and inserting the cut pieces into a negative cover.

To attain the second object of the invention, in accordance with another aspect of the invention, there is provided a photographic processing system comprising: a developing apparatus; a printer; and a transporting apparatus for transporting a negative film fed out from the developing apparatus to the printer, the transporting apparatus including: transport passage means formed of an elongated flexible member and having a pair of mutually opposed grooves for guiding transversely opposite ends of the negative film and extending in a longitudinal direction of the transport passage means; and two coupling portions for respectively coupling opposite ends of the transport passage means to the developing apparatus and the printer.

To attain the third object of the invention, in accordance with still another aspect of the invention, there is provided a photographic film transporting member comprising: an elongated flexible member having a pair of mutually opposed grooves for guiding a photographic film by engaging transversely opposite ends of the photographic film, the grooves extending in a longitudinal direction of the elongated flexible member. A portion of the flexible member in which the grooves are formed is preferably made of a harder material than a remaining portion of the flexible member.

The other objects, features and advantages of the present invention will become more apparent from the following detailed description of the invention when read in conjunction with the accompanying drawings.

DESCRIPTION OF THE PREFERRED EMBODIMENT

Figure 1:
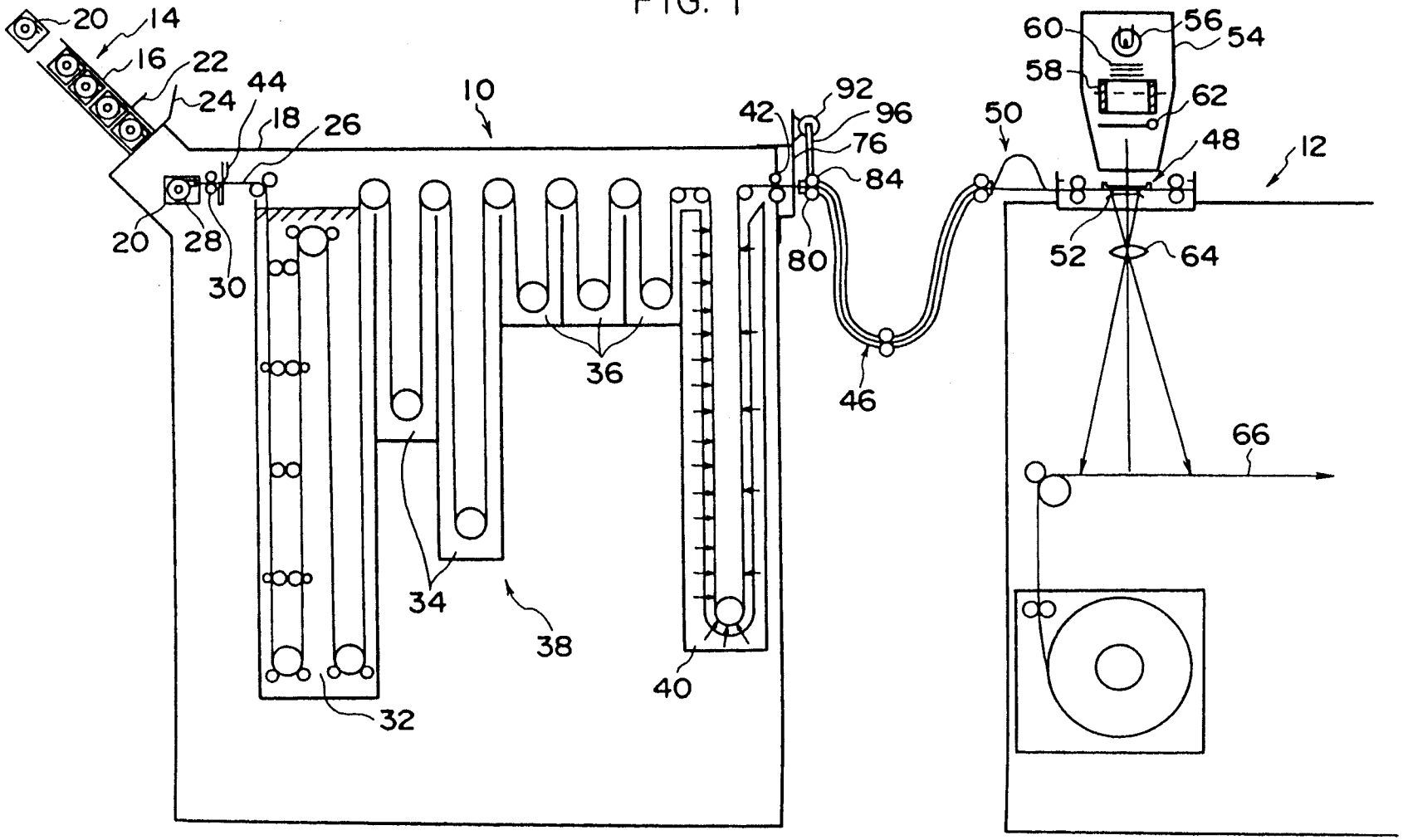
FIG. 1 is a schematic diagram of a photographic processing system in accordance with the present invention.

FIG. 1 shows a photographic processing system using a photographic film transporting apparatus in accordance with the present invention.

As shown in FIG. 1, the photographic processing system mainly comprises a developing apparatus 10 for developing photographed negative films and a printer 12 for printing images on a printing paper through exposure by using the developed negative films. The developing apparatus 10 includes an automatic loading section 14, a processing station 38, and a drying station 40.

The automatic loading section 14 is arranged such that a box-shaped casing 16 is mounted on an upper surface of a developing apparatus casing 18 in a diagonally inclined manner. Cartridges 20 are stacked in the casing 16, and the cartridges 20 thus stacked can be consecutively fed into the developing apparatus casing 18 automatically.

An opening 22 for insertion of the cartridges is provided in a proximal portion of the casing 16, and a cover 24 is provided for the opening 22. In a case where a particular cartridge 20 needs to be preferentially processed, that cartridge 20 can be inserted between the cartridges 20 through the opening 22 after opening the cover 24.

A magazine 28 for supporting a negative film 26 by taking up the film 26 in the form of a roll is accommodated in each cartridge 20, and serves to stably load the negative film 26 therein.

A lowermost one of the cartridges 20 is positioned at a predetermined position in the developing apparatus 10 in the vicinity of the automatic loading section 14. A leading end of the negative film 26 is then drawn out from that cartridge 20, is nipped by a pair of rollers 30 on the downstream side and is fed as the pair of rollers 30 are rotated.

The processing station 38, which includes a developing tank 32, a fixing tank 34, a washing tank 36, and the like, is disposed downstream of the pair of rollers 30. A developer, a fixer, and washing water are stored in the developing tank 32, the fixing tank 34, and the washing tank 36, respectively. The negative film 26 nipped and transported by the pair of rollers 30 is consecutively immersed in the respective processing tanks so as to be subjected to development processing, fixation processing, and wash processing, respectively.

The drying station 40 is disposed downstream of the washing tank 36. The negative film 26 for which wash processing has been completed is transported to the drying station 40 so as to be subjected to dry processing with warm air and is discharged through a discharge port 42 in the developing apparatus casing 18.

When the entire negative film 26 is drawn out from the magazine 28, a cutter 44 is actuated to cut off the negative film 26, and processing is continued with respect to the negative film 26 thus cut off.

The negative film 26 discharged through the discharge port 42 is transported to the printer 12 via a flexible transporting section 46. A detailed description will be given of the flexible transporting section 46.

The negative film 26 transported to the printer 12 is fed by each frame by the negative carrier 48. Here, since the negative film 26 fed through the flexible transporting section 46 is fed at a constant speed, a loop portion 50 is formed upstream of the negative carrier 48 so as to absorb a difference in the amount of transport between the transport by the flexible transporting section 46 and the transport through feeding by each frame.

The negative carrier 48 is provided with a mask 52 having a through hole of the same size as the image frame. The peripheral edges of the image frame can be held by the mask 52.

A light source unit 54 is disposed above the negative carrier 48. A light source 56, a light diffusion cylinder 58, filters 60, and a shutter 62 are provided in the light source unit 54 along an optical path thereof. That is, when the shutter 62 is opened, the light from the light source 56 is applied to the negative film 26 via the filters 60 and the light diffusion cylinder 58. The light transmitted through the negative film 26 passes through the through hole in the mask 52, and forms an image on a printing paper 66 via a lens 64.

The printing paper 66 has been wound in the form of a roll, and is consecutively paid out in correspondence with the frame feeding of the negative film 26. The printing paper 66 for which the print processing has been completed is transported to a processor unit (not shown) so as to be subjected to development processing.

The developing apparatus 10 and the printer 12 described above can be formed separately by using the photographic film transporting apparatus in accordance with the present invention, and their relative positions can be changed freely. To transport the negative film 26 reliably from the developing apparatus 10 to the printer 12, the developing apparatus 10 and the printer 12 are connected together by means of the flexible transporting section 46 such that the negative film transporting passage can be bent or curved three-dimensionally. The negative film 26 is thus transported in correspondence with the relative positions of the developing apparatus 10 and the printer 12. A detailed description will be given hereafter of the arrangement of the flexible transporting section 46.

Figure 2:
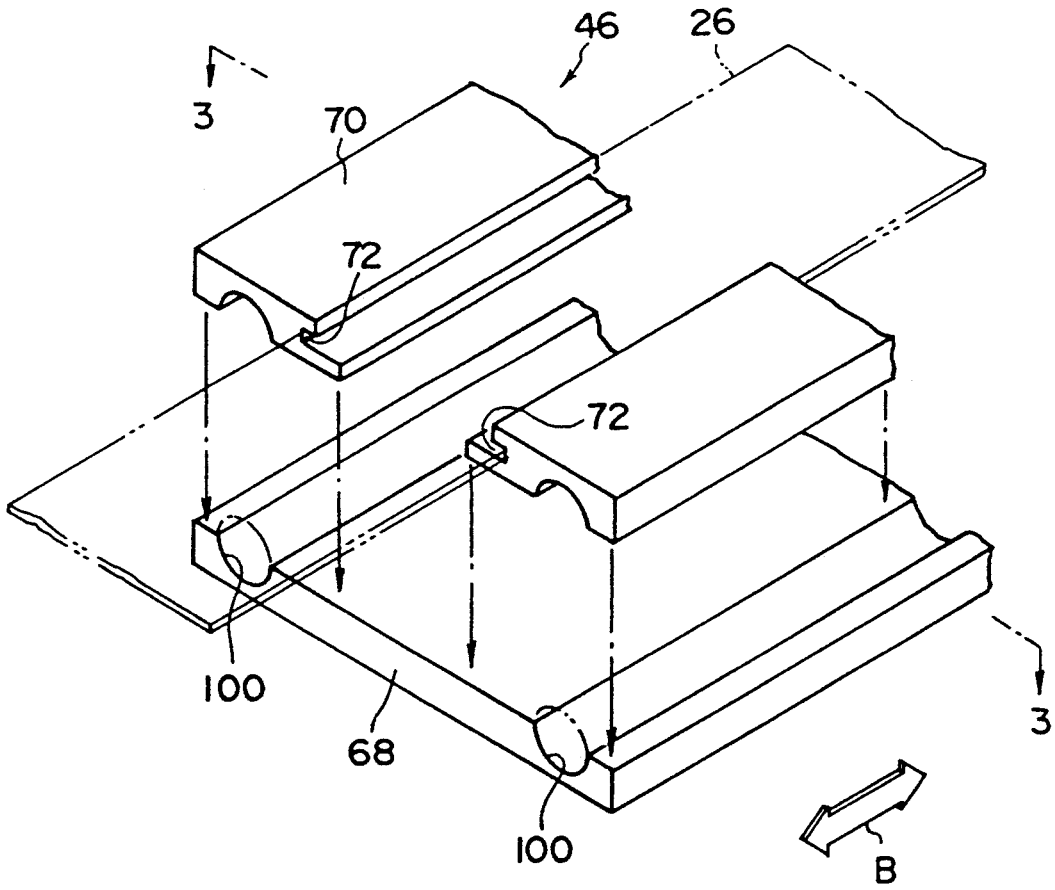
FIG. 2 is an exploded perspective view of a flexible transporting section including a transporting passage base and guiding members.
Figure 3:
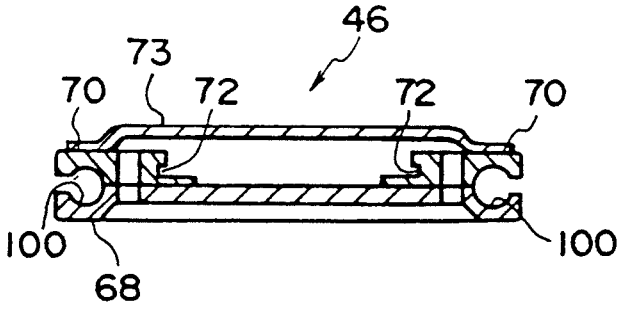
FIG. 3 is a cross-sectional view taken along line 3—3 in FIG. 2.

FIG. 2 is an exploded perspective view of the flexible transporting section, and FIG. 3 is a cross-sectional view taken along line 3—3 in FIG. 2. The flexible transporting section 46 has a transporting passage base 68 formed of a flexible soft synthetic resin as well as a pair of guiding members 70 for supporting and guiding the negative film 26.

The pair of guiding members 70 are fixed on the transporting passage base 68, and are respectively disposed on side portions of the base 68. The guiding members 70 extend in the longitudinal direction (in the direction of arrow B in FIG. 2) of the base 68 and support the side portions of the negative film 26 traveling on the transporting passage base 68.

Mutually opposing surfaces of the guiding members 70 are formed in a substantially U-shaped, stepped configuration in terms of their sections, thereby forming grooves 72, respectively. (Of the two transversely projecting portions of the respective guiding members 70, the one located closer to the transporting passage base 68 is transversely longer than the other.) The transversely opposite ends of the negative film 26 are accommodated in and guided by the grooves 72.

The guiding members 70 are formed of a harder synthetic resin than the material used for the transporting passage base 68. Hence, it is possible to reduce the frictional resistance occurring when the negative film 26 is brought into sliding contact with the inner surfaces of grooves 72 in the guiding members 70. The coupling between the guiding members 70 and the transporting passage base 68 can be effected through double extrusion or adhesion of the synthetic resins. A dust prevention cover 73 may be provided in such a manner as to span the guiding members 70, as shown in FIG. 3.

Figure 7:
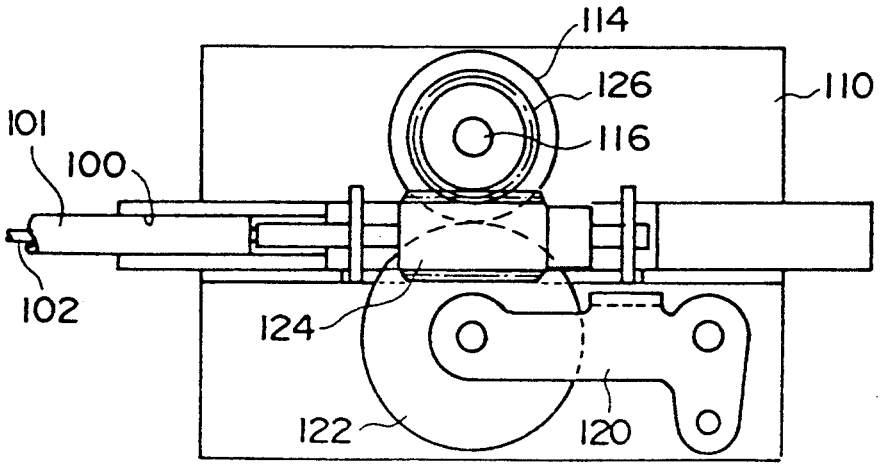
FIG. 7 is a cross-sectional view taken along line 7—7 in FIG. 6.

A groove 100 having a substantially circular section is formed in each of the transversely opposite ends of the flexible transporting section 46 formed by the transporting passage base 68 and the guiding members 70. A wire 102 is accommodated in each groove 100. It should be noted that the wire 102 may be provided with a wire cover 101, as shown in FIG. 7.

One end of the transporting passage base 68 is fixed to a vicinity of the discharge port 42 of the developing apparatus 10, so that the negative film 26 discharged through the discharge port 42 in the developing apparatus 10 shown in FIG. 1 is fed onto the transporting passage base 68.

Meanwhile, the other end of the transporting passage base 68 is fixed to the printer 12 upstream of the loop portion 60, so that the negative film 26 on the transporting passage base 68 can be fed reliably into the loop portion 50 of the printer 12 shown in FIG. 1.

A longitudinally intermediate portion of the transporting passage base 68 is adapted to be bent or curved three-dimensionally, i.e., in a flexible manner, in correspondence with the relative positions of the developing apparatus 10 and the printer 12, while the state of connection of the transporting passage base 68 to the developing apparatus 10 and the printer 12 is maintained.

Figure 4:
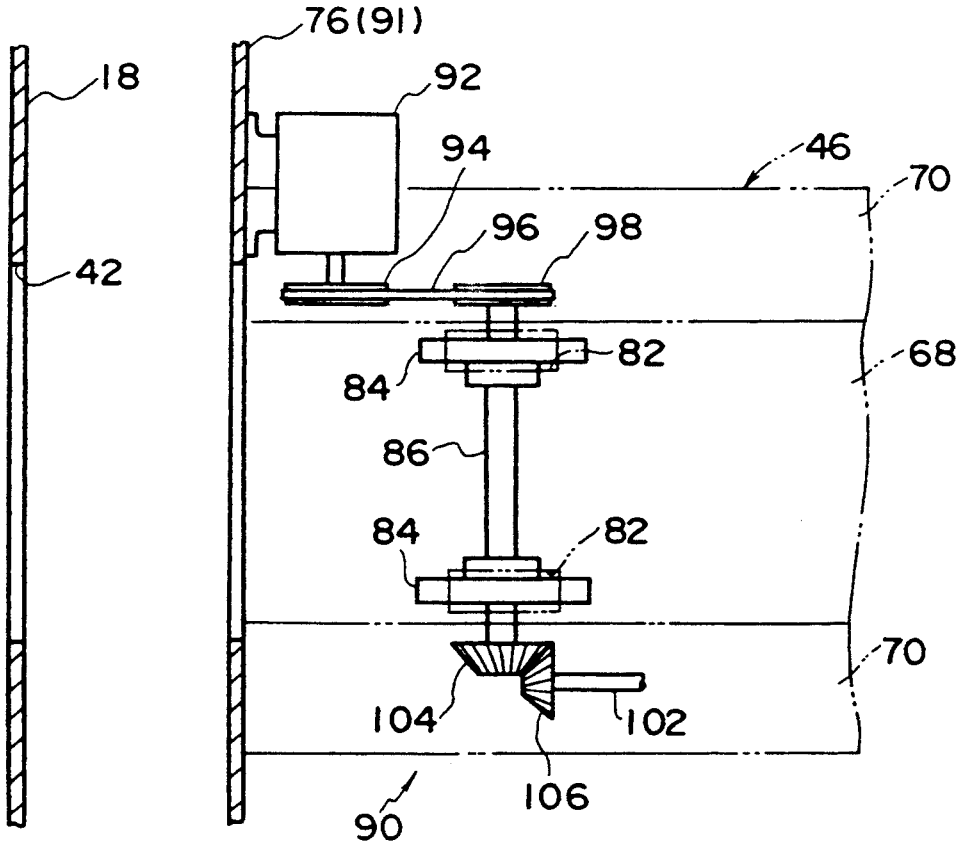
FIG. 4 is a partly sectional plan view illustrating a state of connection of a developing apparatus-side end portion of a flexible transporting section.
Figure 5:
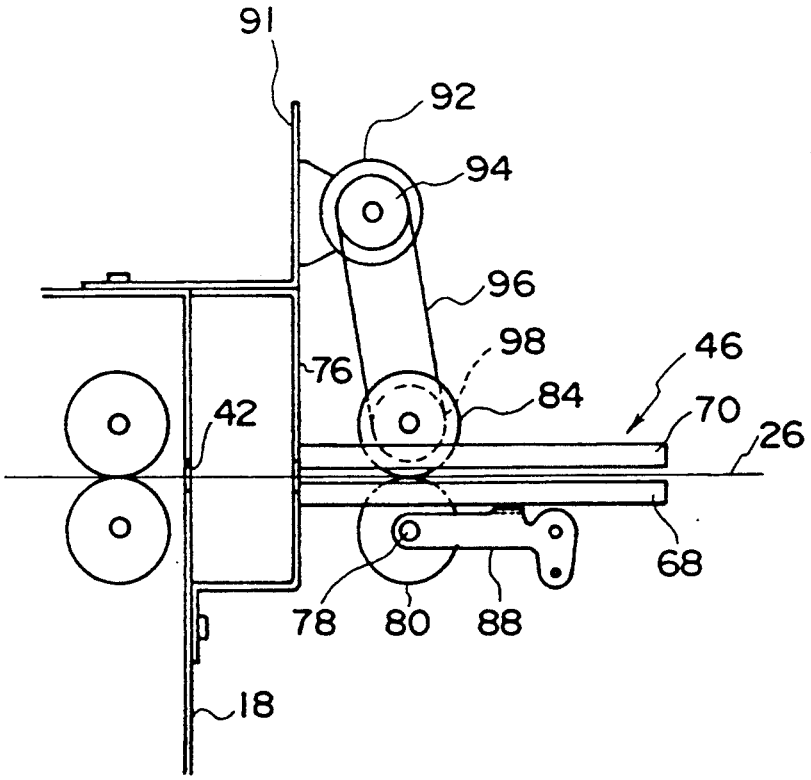
FIG. 5 is a side elevational view illustrating the state of connection of the developing apparatus-side end portion of the flexible transporting section.

FIGS. 4 and 5 are a plan view and a cross-sectional view, respectively, of an end transport mechanism 90 which is located at an end of the flexible transporting section 46 and adapted to transport the negative film 26 through the flexible transporting section 46. FIGS. 4 and 5 also show a state of connection between the developing apparatus 10 and the flexible transporting section 46. One end of the transporting passage base 68 is fixed to a driving-system bracket 76 secured to a vertical wall of the developing apparatus casing 18.

A rotating shaft 78 is disposed transversely at an end portion of the transporting passage base 68 on a reverse-surface side thereof. A pair of thin-walled rollers 80 are fixed on the rotating shaft 78 in the vicinities of transversely opposite ends of the transporting passage base 68. Each roller 80 has a portion accommodated in a respective rectangular through hole 82 formed in the transporting passage base 68, and its peripheral surface projects upward from an obverse-surface side of the transporting passage base 68 and abuts-against each of a pair of rollers 84 disposed on the obverse-surface side of the base 68.

The rotating shaft 78 for pivotally supporting the rollers 80 disposed on the reverse-surface side is pivotally supported at opposite ends thereof by one ends of a pair of arms 88 whose other ends are pivotally supported on the reverse-surface side of the transporting passage base 68. The arms 88 are urged by an unillustrated urging means in a direction in which the rollers 80 are brought into contact with the rollers 84.

An end transport mechanism (designated by reference numeral 134 in FIG. 10) having a similar arrangement is also disposed at the other end of the flexible transporting section 46 on the printer 12 side.

The driving-system bracket 76 is fixed to the vertical wall of the developing apparatus casing 18 in such a manner as to surround the discharge port 42 in the developing apparatus 10, an upper surface of the driving-system bracket 76 being flush with an upper surface of the casing 18. A motor 92 serving as a driving source is fixed to the upper surface of the driving-system bracket 76 via an L-shaped bracket 91. By virtue of this bracket 76, the transporting apparatus in accordance with the present invention can be readily mounted on the developing apparatus 10.

A pulley 94 is fixed on a rotating shaft of the motor 92, and an endless belt 96 is trained between the pulley 94 and a pulley 98 fixed on a rotating shaft 86 of the rollers 84 on the obverse-surface side of the transporting passage base 68. Consequently, the rollers 84 are rotated by the driving force of the motor 92, so that a transporting force can be imparted to the negative film 26 nipped by the rollers 84 and the reverse surface-side rollers 80.

The wire 102 accommodated in one of the grooves 100 in the flexible transporting section 46 extends from the end transport mechanism 90 to an intermediate portion of the flexible transporting section 46, while the wire 102 accommodated in the other groove 100 extends from the intermediate portion of the flexible transporting section 46 to the end transport mechanism 134 located on the printer 12 side of the flexible transporting section 46.

A bevel gear 106 is fixed to one end of the wire 102 on the developing apparatus 10 side, and meshes with a bevel gear 104 fixed on the rotating shaft 86 of the rollers 84. Consequently, the wire 102 is pivotally rotated by the driving force of the motor 92. Although an axis of the wire 102 is curved along the direction in which the flexible transporting section 46 is curved, the wire 102 is formed of such a material and with such dimensions that permit the axial rotation of the wire despite its curvature.

Figure 6:
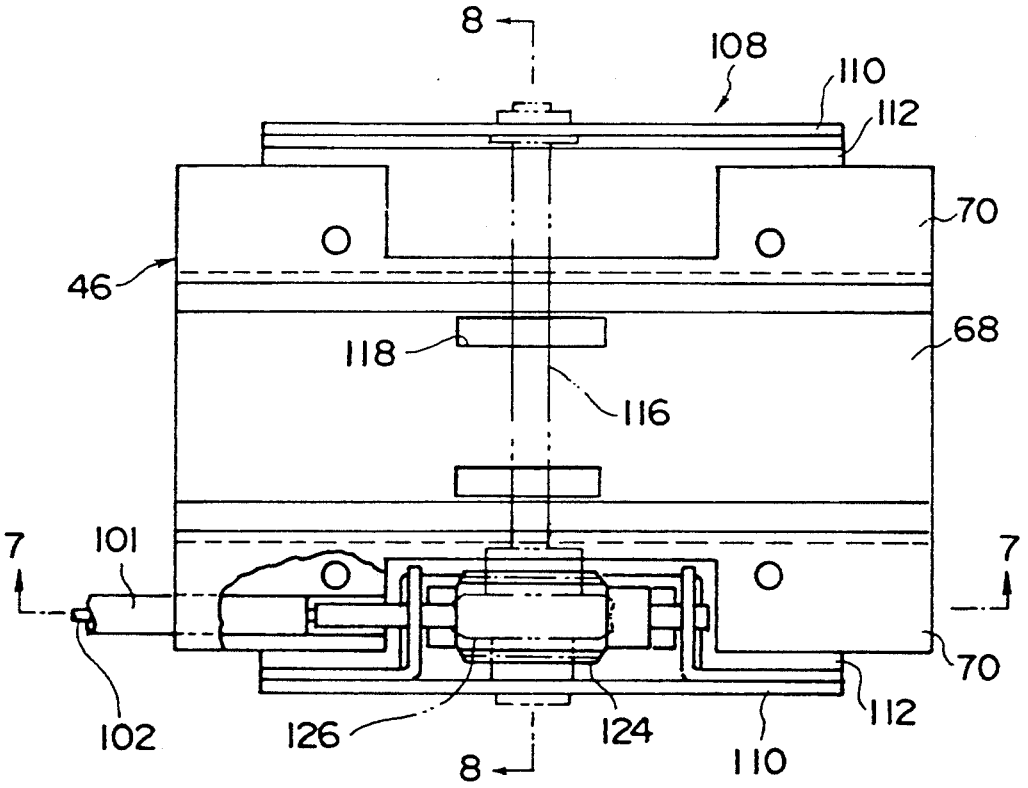
FIG. 6 is a plan view of an intermediate transport mechanism section.
Figure 8:
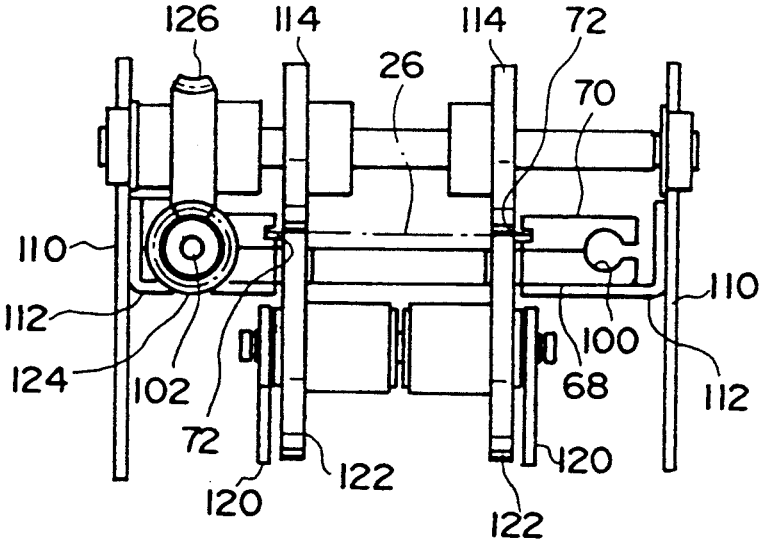
FIG. 8 is a cross-sectional view taken along line 8—8 in FIG. 6.

FIGS. 6 to 8 show an intermediate transport mechanism 108 located at an intermediate portion of the flexible transporting section 46. The intermediate transport mechanism 108 has a pair of mutually parallel brackets 110 disposed in such a manner as to sandwich the transporting passage base 68. The pair of brackets 110 are secured to the transporting passage base 68 via L-shaped brackets 112, respectively.

Opposite ends of a rotating shaft 116 of a pair of rollers 114, which are disposed on the obverse-surface side of the transporting passage base 68, are pivotally supported by the pair of brackets 110. A pair of rectangular through holes 118 are formed in the intermediate portion of the transporting passage base 68 in the same way as in the end transport mechanism 90. A portion of a peripheral surface of each of a pair of rollers 122, which are swingable by a pair of arms 120 disposed on the reverse-surface side of the transporting passage base 68, projects upward from the base 68 through the rectangular through hole. The rollers 122 are also urged by an unillustrated urging means in a direction in which the rollers 122 are brought into contact with the rollers 114.

A worm gear 124 is fixed at an end of the wire 102 extending from the end transport mechanism 90 to the intermediate transport mechanism 108, and meshes with a worm wheel 126 fixed on the rotating shaft 116 of the obverse-surface side rollers 114. Consequently, the driving force of the motor 92 shown in FIG. 5 is transmitted to the rollers 114 via the wire 102, so that the rollers 114 rotate. As the negative film 26 is nipped by the rollers 114 and the rollers 122, the negative film 26 receives the transporting force and can be transported toward the printer 12.

Figure 10:
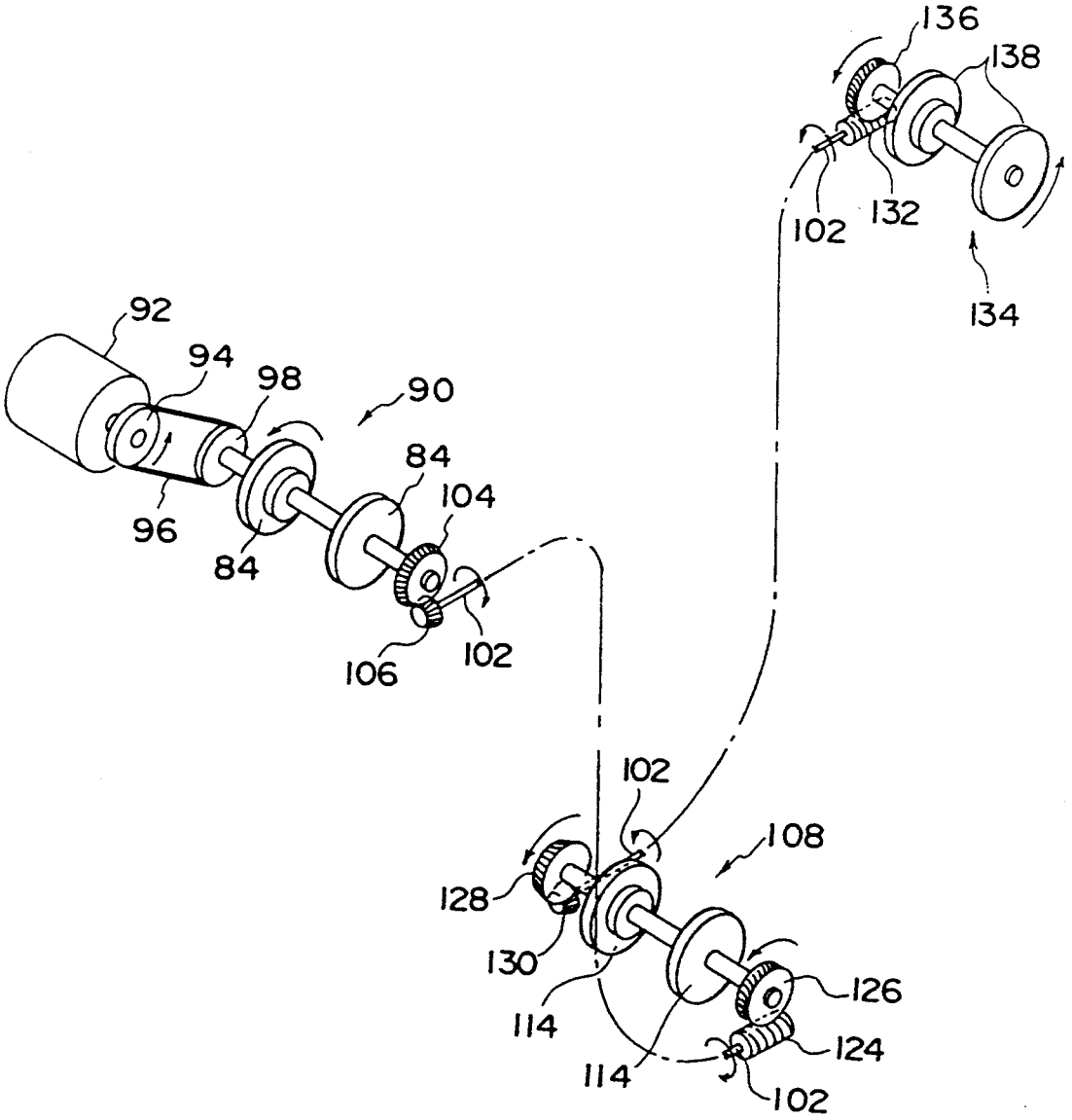
FIG. 10 is a perspective view illustrating an outline of a driving system in accordance with the present invention.

FIG. 10 shows a schematic diagram of a driving system of the flexible transporting section 46 including the end transport mechanisms 90, 134 and the intermediate transport mechanism 108. A bevel gear 128 is fixed on an end of the rotating shaft 116 of the rollers 114 of the intermediate transport mechanism 108, this end being away from the aforementioned end on which the worm wheel 126 is fixed. This bevel gear 128 meshes with a bevel gear 130 fixed on one end of the wire 102.

This wire 102 extends to the end transport mechanism 134 on the printer 12 side, and a worm gear 132 is fixed on the other end of the wire 102. The end transport mechanism 134 is fixed on the end of the transporting passage base 68 on the printer 12 side, and is arranged in a manner similar to that of the end transporting mechanism 90 on the developing apparatus 10 side. The worm gear 132 meshes with a worm wheel 136, and a pair of rollers 138 are rotated as the wire 102 is axially rotated.

As shown in FIG. 10, the motor 92 on the developing apparatus 10 side serves as a driving source for the entire rollers of the flexible transporting section 46. As the motor 92 rotates, the rollers 84 rotate, and the wire 102 is axially rotated by means of the bevel gears 104, 106, which in turn causes the rollers 114 to rotate by means of the worm gear 124 and the worm wheel 126. As the rollers 114 rotate, the wire 102 is axially rotated by means of the bevel gears 128, 130, which in turn causes the rollers 138 to rotate by means of the worm gear 132 and the worm wheel 136.

A description will now be given of the operation for effecting print processing after developing photographic films by using a photographic processing system including the photographic film transporting apparatus in accordance with the present invention.

Referring to FIG. 1, the magazines 28, in which photographed negative films 26 taken up in the form of rolls are accommodated, are loaded in the respective cartridges 20. The cartridges 20 are inserted into the casing 16 of the automatic loading section 14 so as to be stacked therein.

In the automatic loading section 14, the cartridges 20 are consecutively fed to the predetermined position inside the developing apparatus 10 starting with a lowermost cartridge 20 so as to be positioned. The leading end of the negative film 26 drawn out from the positioned cartridge 20 is nipped by the pair of rollers 30, and the negative film 26 is fed to the processing station 38 as the pair of rollers 30 rotate.

In the processing section 38, the negative film 26 is immersed in the developing tank 32, the fixing tank 34, and the washing tank 36 in that order so as to be subjected to development processing, fixation processing, and wash processing.

The negative film 26 for which each stage of processing mentioned above has been completed is subjected to dry processing in the drying station 40, and is discharged through the discharge port 42.

The discharged negative film 26 is nipped by the rollers 80, 84 of the end transport mechanism 90 located at the end of the flexible transporting section 46, and is allowed to engage in the grooves 72 in the guiding members 70.

When the motor 92 rotates, its driving force is transmitted to the rollers 84 via the belt 96 to apply a transporting force to the negative film 26, so that the negative film 26 is transported along the transport passage of the flexible transporting section 46 while being guided by the grooves 72.

The intermediate transport mechanism 108 is provided in the intermediate portion of the flexible transporting section 46, as described above, so that the rotation of the rollers 84 of the end transport mechanism 90 on the developing apparatus 10 side rotates the worm gear 124 of the intermediate transport mechanism 108 via the wire 102. Since the wire 102 is accommodated in the grooves 100 provided in the transport passage, the wire 102 rotates axially despite its curved condition. As the worm gear 124 rotates, the rollers 114, 122 of the intermediate transport mechanism 108 rotate. Consequently, even of the rear end of the negative film 26 leaves the end transport mechanism 90 on the developing apparatus 10 side, the transport of the negative film 26 can be continued.

Furthermore, since the rotational force of the roller 114 of the intermediate transport mechanism 108 is transmitted to the end transport mechanism 134 on the printer 12 side via the wire 102 by means of a similar arrangement, even if the rear end of the negative film 26 leaves the intermediate transport mechanism 108, the transport of the negative film 26 can be continued.

Thus, as the intermediate transport mechanism 108 is provided, the transport passage can be made long irrespective of the overall length of the negative film 26, so that the degree of freedom in selecting a place of installation of the developing apparatus 10 and the printer 12 can be enhanced. In addition, since the rotation of the roller 114 of the intermediate transport mechanism 108 is transmitted through axial rotation, the rotational force can be transmitted reliably despite the curved condition of the transporting passage base 68.

It should be noted that, instead of the above-described arrangement in which the wires 102 are interlinked for axial rotation, a motor may be additionally provided as an intermediate driving portion. However, such an arrangement becomes large in scale and results in a higher cost, so that the structure of the above-described embodiment is most suitable.

The negative film 26 guided by the flexible transporting section 46 is fed to the printer 12 for an ensuing process. The loop portion 50 is provided on the uppermost stream side of the printer 12, and after a loop is formed by the negative film 26, the negative film 26 is transported to the negative carrier 48.

In the negative carrier 48, the negative film 26 is fed by each image frame, and each image frame is positioned at the through hole in the mask 52. Then, when the shutter 62 is opened, the light from the light source 56 is radiated through the filters 60 and the light diffusion cylinder 58. The radiated light is transmitted through the negative film 26, and imagewise exposes the printing paper 66 via the lens 64.

As this process is repeated, the images on the negative film 26 are consecutively printed onto the printing paper. Here, the negative carrier 48 feeds the negative film 26 by each image frame, and the negative film 26 is fed in from the flexible transporting section 46 at a constant speed. The difference in the amount of transport is absorbed by changing the size of the loop of the negative film 26 in the loop portion 50, thereby to transport the negative film 26 smoothly.

The printing paper 66 on which an image is printed is subjected to development processing by the processor unit in an ensuing process, is cut for each image, and is returned to the customer.

In this embodiment, since the developing apparatus 10 and the printer 12 are connected together by means of the flexible transporting section 46, the developing apparatus 10 and the printer 12 can be arranged separately, and places of their installation can be determined freely. In particular, they can be installed by securing a working space for maintenance.

In addition, the grooves 72, in which the transversely opposite ends of the negative film 26 are accommodated, are formed in the guiding members 70. These guiding members 70 are formed of a harder synthetic resin than the transporting passage base 68, and their frictional resistance when the negative film 26 is brought into sliding contact therewith is low. In addition, even if the transporting passage base 68 is bent three-dimensionally, the grooves 72 are unlikely to be crushed or deformed, thereby making it possible to transport the negative film 26 smoothly.

Figure 9A:
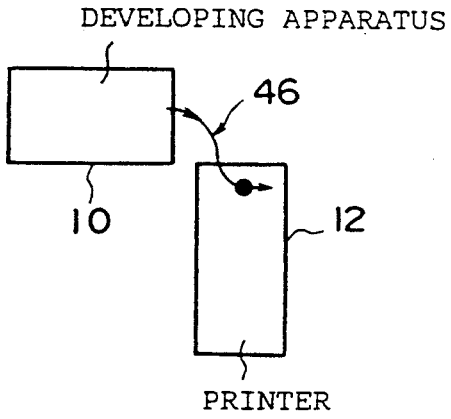
FIGS. 9A to 9C are schematic diagrams illustrating patterns of the layout of the developing apparatus and a printer.
Figure 9B:
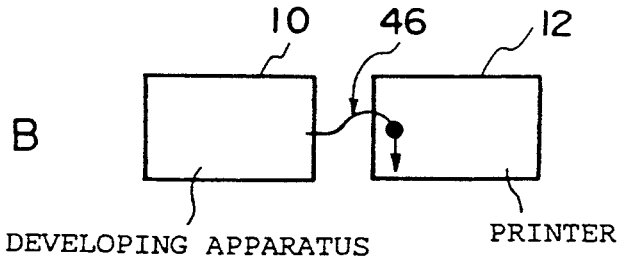
Figure 9C:
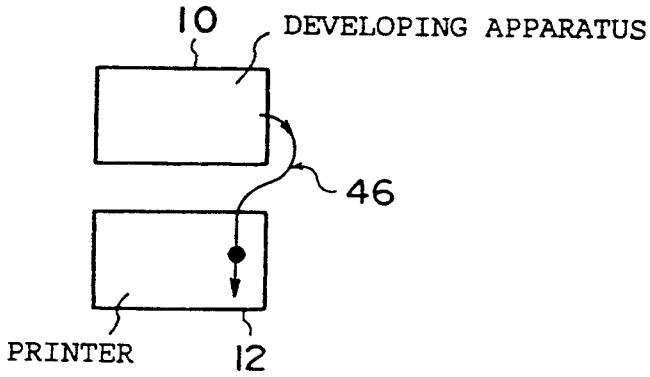

In accordance with this embodiment, the degree of freedom in the layout of the developing apparatus 10 and the printer 12 is enhanced. For instance, the developing apparatus 10 and the printer 12 can be arranged in a substantially L-shaped layout as shown in FIG. 9A, or in a series as shown in FIG. 9B, or in parallel as shown in FIG. 9C. Consequently, the limited installation space can be effectively utilized, and the working space for maintenance can be secured sufficiently.

Although, in this embodiment, the motor 92 is provided as the driving and transporting source for the flexible transporting section 46, it is possible to use a driving source located in the developing apparatus 10 to transport the negative film 26 in the flexible transporting section 46.

Although, in this embodiment, the opposite ends of the flexible transporting section 46 are respectively connected to the developing apparatus 10 and the printer 12, if the transport passage is elongated by connecting together a plurality of flexible transporting sections 46, the degree of freedom in the selection of the installation places of the developing apparatus 10 and the printer 12 can be further enhanced.

Although the printer 12 used in this embodiment is of a so-called erect type (the type in which the light source is located above the negative film 12), there are printers of a so-called inverted type in which the light source is located below the negative film 26. In this case, it is necessary to invert the obverse and reverse sides of the negative film 26. In that case, since the flexible transporting section 46 in accordance with this embodiment is flexible, the transport passage can be easily twisted 180° to feed the negative film 26 into the printer in an inverted state.

Although, in this embodiment, the developing apparatus 10 and the printer 12 are used as processing apparatuses, the flexible transporting section 46 of this embodiment may also be used between two apparatuses for continuously processing the negative films 26, such as the printer and an apparatus for cutting the negative films 26 into units of six frames and inserting the cut piece negatives into negative covers.

As described above, the photographic film transporting apparatus in accordance with the present invention offers outstanding advantages in that when two types of processing operations are effected continuously, the degree of freedom in the layout of the installation places of the processing apparatuses for the operations can be enhanced, and that a decline in the operating efficiency in maintenance can be prevented.

What is claimed is:

1. A photographic film transporting apparatus comprising:

transport passage means formed of an elongated flexible member and having a pair of mutually opposed grooves for guiding transversely opposite ends of a photographic film and extending in a longitudinal direction of said transport passage means; and two coupling portions for respectively coupling opposite ends of said transport passage means to two photographic film processing apparatuses.

2. A photographic film transporting apparatus according to claim 1, further comprising:

at least one driving means for transporting the photographic film.

3. A photographic film transporting apparatus according to claim 1, further comprising:

at least one driving means for transporting the photographic film;

a driving source for imparting a driving force to said driving means; and flexible transmitting means for transmitting the driving force of said driving source to said driving means.

4. A photographic film transporting apparatus according to claim 3, wherein said driving means comprises rollers.

5. A photographic film transporting apparatus according to claim 3, wherein said flexible transmitting means comprises at least one wire, and at least one groove for accommodating said wire and extending in the longitudinal direction is formed in said transport passage means.

6. A photographic film transporting apparatus according to claim 1, wherein a portion of said flexible member in which said grooves for guiding the transversely opposite ends of the photographic film are formed is made of a harder material than a remaining portion of said flexible member.

7. A photographic film transporting apparatus according to claim 1, wherein one of said photographic processing apparatuses is a developing apparatus, the other is a printer, and the photographic film is a negative film.

8. A photographic film transporting apparatus according to claim 1, wherein one of said photographic processing apparatuses is a printer, the other is an apparatus for cutting the photographic film and inserting the cut pieces into a negative cover, and the photographic film is a negative film.

9. A photographic film transporting apparatus according to claim 3, wherein a driving source for transporting the photographic film and mounted to one of said photographic processing apparatuses is used as said driving source.

10. A photographic film transporting apparatus according to claim 1, wherein said photographic film transporting apparatus is a negative film transporting apparatus comprising:

transport passage means formed of an elongated flexible member and having a pair of mutually opposed grooves for guiding transversely opposite ends of a negative film and extending in a longitudinal direction of said transport passage means;

two coupling portions for respectively coupling opposite ends of said transport passage means to a photographic developing apparatus and a printer;

at least one driving means disposed in said transport passage means, for transporting the negative film;

a driving source for imparting a driving force to said driving means; and flexible transmitting means for transmitting the driving force of said driving source to said driving means, wherein at least one groove for accommodating said transmitting means is formed in said transport passage means, and wherein a portion of said flexible member in which said grooves for guiding the transversely opposite ends of the negative film are formed is made of a harder material than a remaining portion of said flexible member.

11. A photographic film transporting apparatus according to claim 10, wherein said driving means comprises rollers.

12. A photographic film transporting apparatus according to claim 10, wherein said flexible transmitting means comprises at least one wire.

13. A photographic processing system comprising:

a developing apparatus;

a printer; and a transporting apparatus for transporting a negative film fed out from said developing apparatus to said printer, said transporting apparatus including: transport passage means formed of an elongated flexible member and having a pair of mutually opposed grooves for guiding transversely opposite ends of the negative film and extending in a longitudinal direction of said transport passage means; and two coupling portions for respectively coupling opposite ends of said transport passage means to said developing apparatus and said printer.

14. A photographic processing system according to claim 13, further comprising:

at least one driving means for transporting the negative film.

15. A photographic processing system according to claim 13, further comprising:

at least one driving means for transporting the negative film;

a driving source for imparting a driving force to said driving means; and flexible transmitting means for transmitting the driving force of said driving source to said driving means.

16. A photographic processing system according to claim 15, wherein said driving means comprises rollers.

17. A photographic processing system according to claim 15, wherein said flexible transmitting means comprises at least one wire, and at least one groove for accommodating said wire and extending in the longitudinal direction is formed in said transport passage means.

18. A photographic processing system according to claim 13, wherein a portion of said flexible member in which said grooves for guiding the transversely opposite ends of the negative film are formed is made of a harder material than a remaining portion of said flexible member.

19. A photographic film transporting member comprising:

an elongated flexible member having a pair of mutually opposed grooves for guiding a photographic film by engaging transversely opposite ends of the photographic film, said grooves extending in a longitudinal direction of said elongated flexible member.

20. A photographic film transporting member according to claim 19, wherein a portion of said flexible member in which said grooves are formed is made of a harder material than a remaining portion of said flexible member.

* * * * *